US008142002B2

(12) United States Patent
Xu et al.

(10) Patent No.: US 8,142,002 B2
(45) Date of Patent: Mar. 27, 2012

(54) ROTATING COANDA CATCHER

(75) Inventors: Jinquan Xu, Tolland, CT (US); Robert E. Zeman, Webster, NY (US); Roger S. Kerr, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 251 days.

(21) Appl. No.: 12/468,077

(22) Filed: May 19, 2009

(65) Prior Publication Data

US 2010/0295911 A1 Nov. 25, 2010

(51) Int. Cl.
*B41J 2/185* (2006.01)

(52) U.S. Cl. ..... 347/90

(58) Field of Classification Search ..... 347/90, 347/73–82

See application file for complete search history.

(56) References Cited

U.S. PATENT DOCUMENTS

| | | | | |
|---|---|---|---|---|
| 3,373,437 | A | 3/1968 | Sweet et al. | |
| 4,138,686 | A | 2/1979 | Graf | |
| 4,249,188 | A | 2/1981 | Graf | |
| 4,264,910 | A | 4/1981 | Graf | |
| 4,356,500 | A | 10/1982 | Graf | |
| 6,454,835 | B1 | 9/2002 | Baumer | |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,588,889 | B2 * | 7/2003 | Jeanmaire | 347/77 |
| 6,592,213 | B2 | 7/2003 | Long | |
| 6,648,461 | B2 * | 11/2003 | Long | 347/90 |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 2008/0278549 | A1 * | 11/2008 | Xu et al. | 347/77 |

* cited by examiner

*Primary Examiner* — K. Feggins
(74) *Attorney, Agent, or Firm* — William R. Zimmerli

(57) ABSTRACT

A catcher includes a housing and a drop contact structure. The housing defines a liquid removal conduit. The drop contact structure includes a moveable surface that delivers collected liquid drops to the liquid removal conduit of the housing.

20 Claims, 12 Drawing Sheets

ROTATING COANDA CATCHER

FIELD OF THE INVENTION

This invention relates generally to the field of digitally controlled printing systems, and in particular to continuous printing systems.

BACKGROUND OF THE INVENTION

Continuous inkjet printing uses a pressurized liquid source that produces a stream of drops some of which are selected to contact a print media (often referred to a "print drops") while other are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

Drop placement accuracy of print drops is critical in order to maintain image quality. Liquid build up on the drop contact face of the catcher can adversely affect drop placement accuracy. As such, there is a continuing need to provide an improved catcher for these types of printing systems.

SUMMARY OF THE INVENTION

According to one feature of the present invention, a catcher includes a housing and a drop contact structure. The housing defines a liquid removal conduit. The drop contact structure includes a moveable surface that delivers collected liquid drops to the liquid removal conduit of the housing.

According to another feature of the present invention, a method of collecting non-printed liquid drops includes providing a housing defining a liquid removal conduit; providing a drop contact structure including a moveable surface that delivers liquid to the liquid removal conduit of the housing; causing the moveable surface of the drop contact structure to move; and causing liquid drops to contact the moving surface of the drop contact structure.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
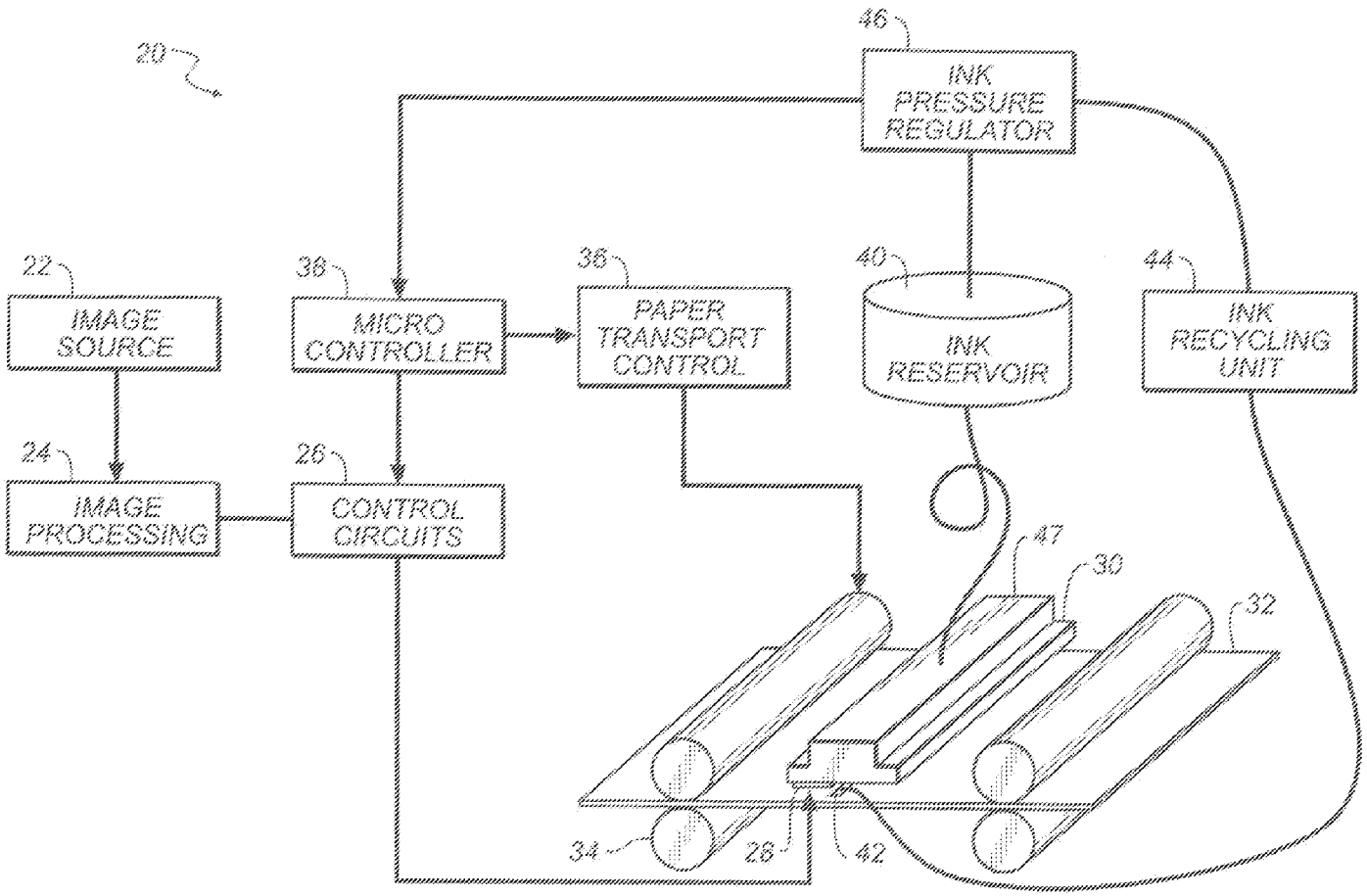
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
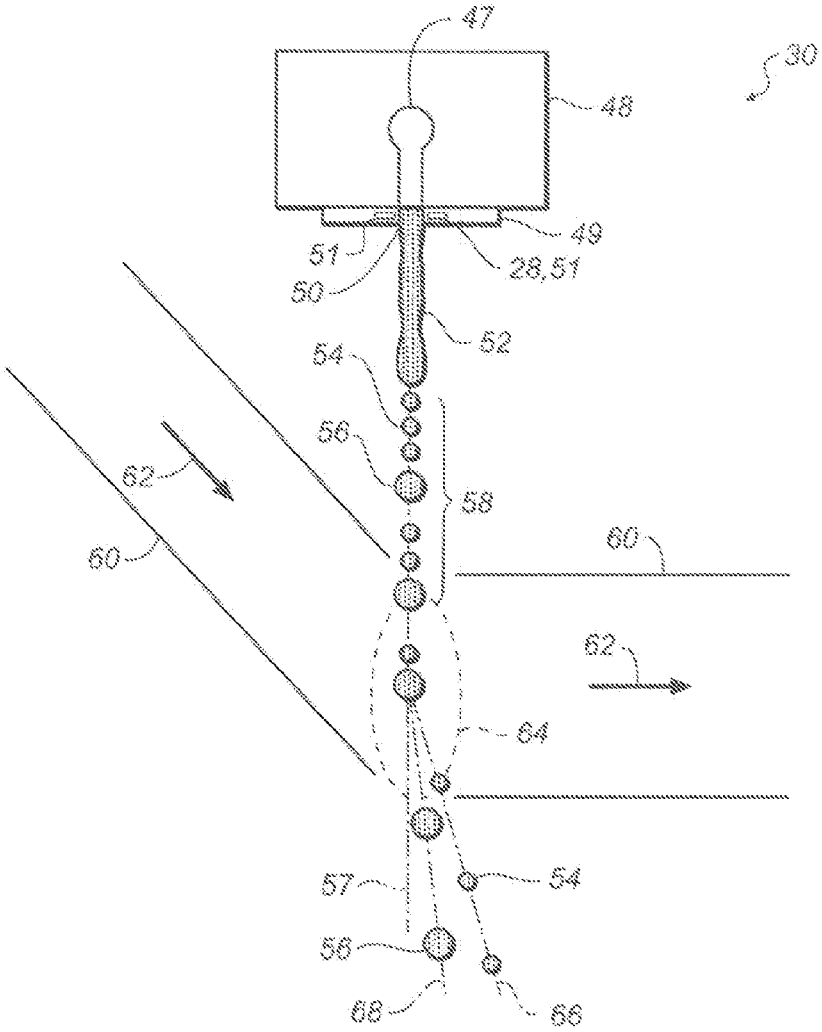
FIG. 2 is a schematic view of an example embodiment of a portion of a continuous printhead made in accordance with the present invention.
Figure 3:
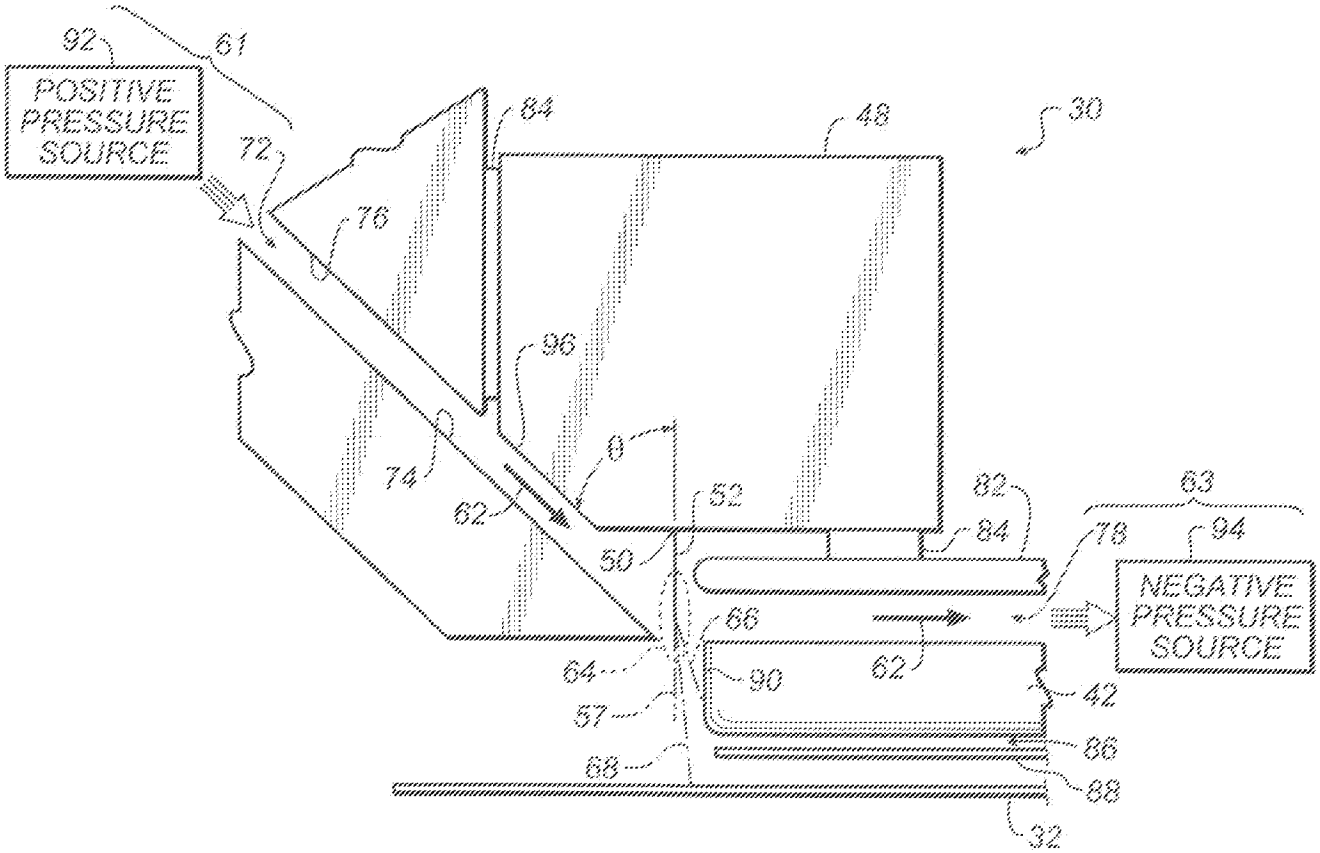
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle $\theta$ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32. Catcher 42 is a type of catcher commonly referred to as a "Coanda" catcher.

Figure 4A:
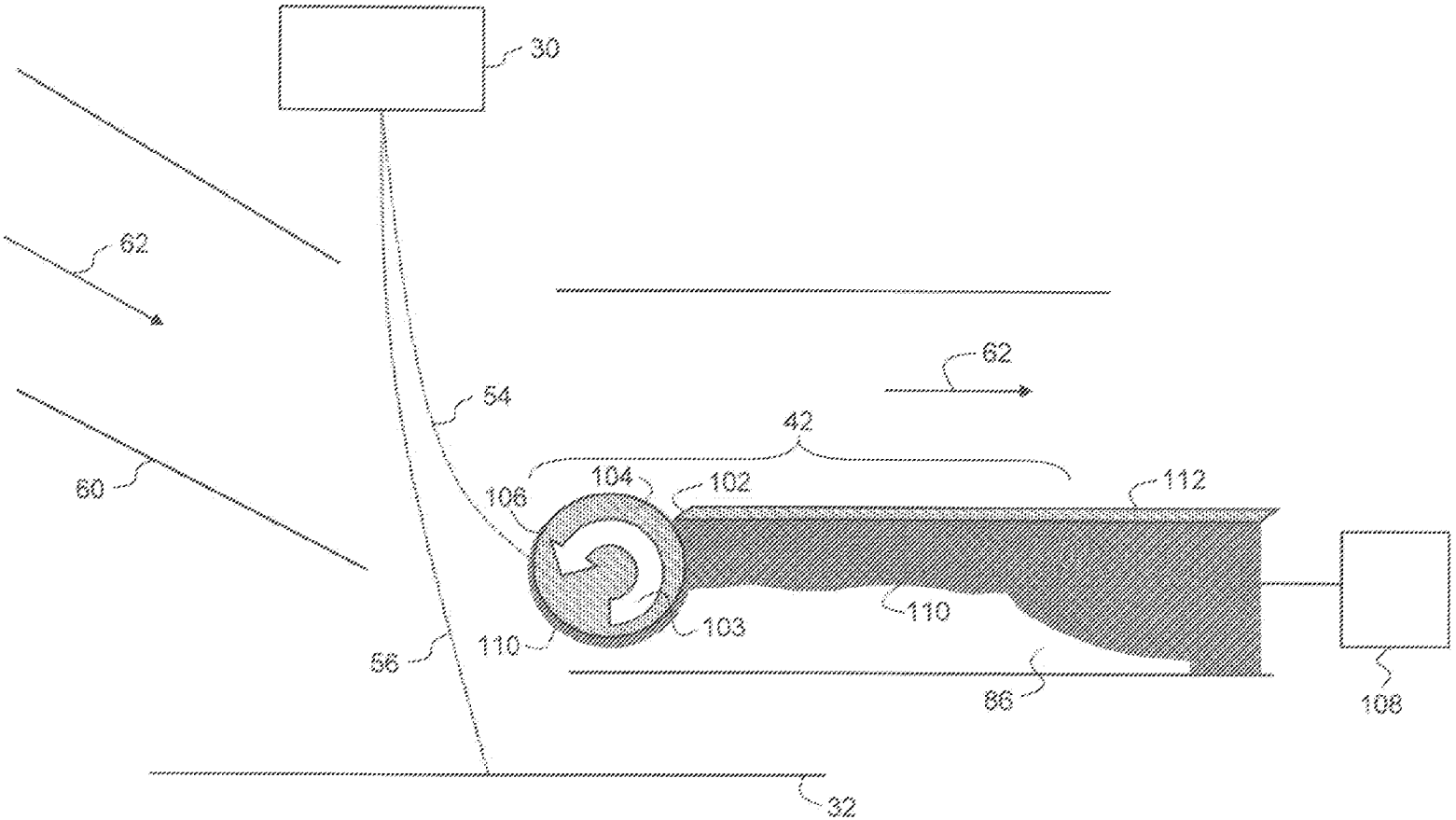
FIG. 4A is a schematic view of an example embodiment of a continuous printhead made in accordance with the present invention.

Referring to FIG. 4A, an example embodiment of a continuous printhead operating in a large drop print mode is shown. Coanda catcher 42 includes a housing defining a liquid removal conduit 86 and a drop contact structure 104. The drop contact structure 104 includes a moveable surface 106. As shown in FIG. 4A, drop contact structure 104 is a drum operatively connected with a drive mechanism, for example, an electric motor, which causes moveable surface 106 (the surface of the drum) to rotate. Moveable surface 106 is a solid surface with a thin layer of accumulated liquid that rotates in a counter clockwise direction (represented by arrow 103). In other example embodiments, moveable surface 106 can rotate in a clockwise direction.

Moveable surface 106 collects small drops 54 and delivers the collected liquid drops to the liquid removal conduit 86 of the housing. Catcher 42 also includes a device that removes at least some of the liquid 110 that accumulates on moveable surface 106 of the drop contact structure 104. As shown in FIG. 4A, the device is a skive 112 that is operatively associated with the drop contact structure 104 to remove at least some of the liquid 110 from the moveable surface 106. Skive 112 includes and end 102 that is spaced apart from moveable surface 106 and removes some of the liquid 110 that has accumulated on moveable surface 106. The removed liquid flows into liquid removal conduit 86 of catcher 42.

A source of vacuum 108 is operatively connected to the liquid removal conduit 86 and creates a negative pressure in the liquid removal conduit 86 to draw liquid 110 in the conduit 86 away from the movable surface 106 of the drop contact structure 104. The source of vacuum 108 can be any conventional vacuum generation mechanism, for example, a fluid pump. Typically, the level of the vacuum applied to conduit 86 is such that liquid 110 can efficiently draw away while at the same time not strong enough to disturb gas flow 62.

Figure 4B:
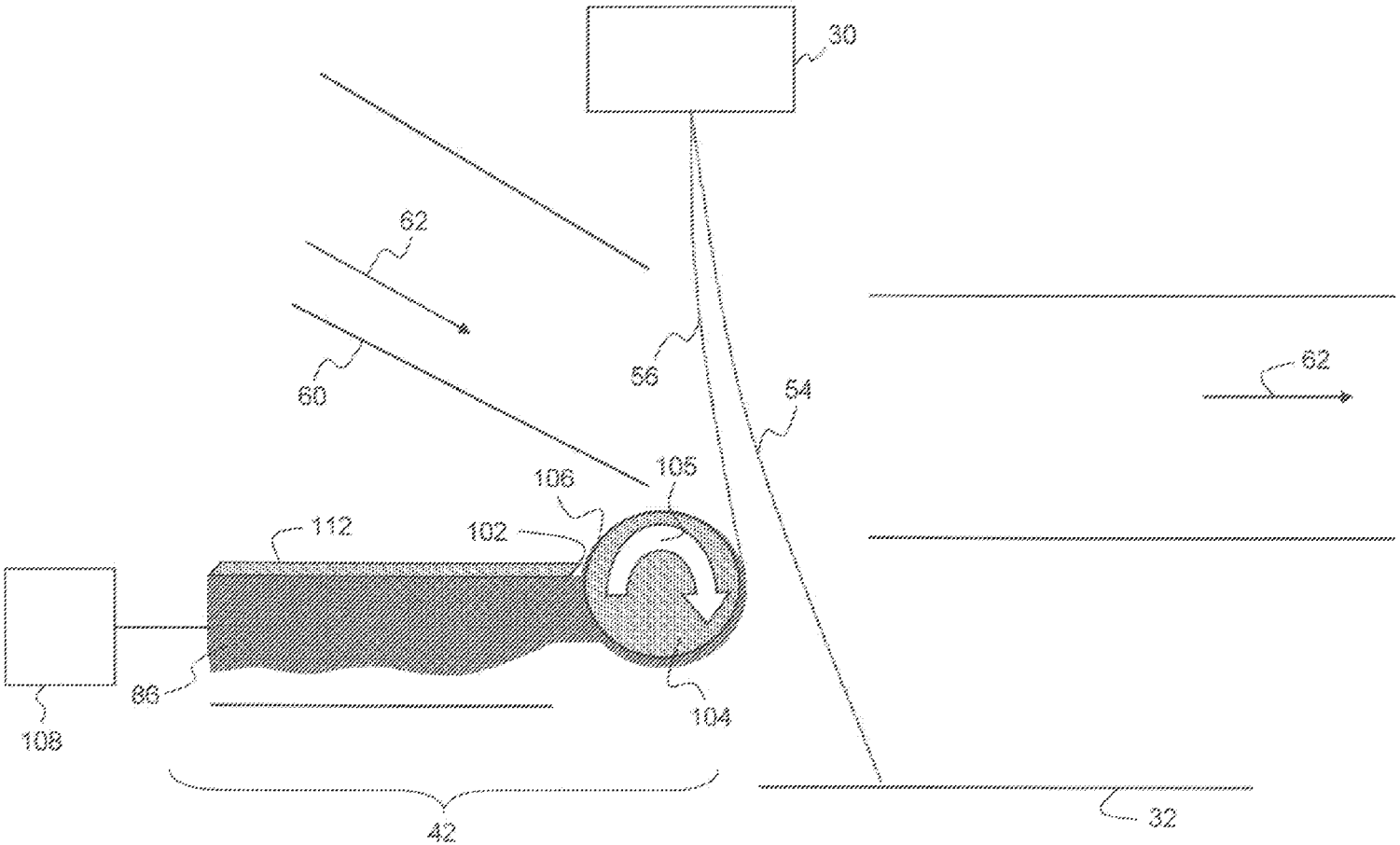
FIG. 4B is a schematic view of another example embodiment of a continuous printhead made in accordance with the present invention.

Referring to FIG. 4B, an example embodiment of a continuous printhead operating in a small drop print mode is shown. Coanda catcher 42 includes a housing defining a liquid removal conduit 86 and a drop contact structure 104. The drop contact structure 104 includes a moveable surface 106. As shown in FIG. 4B, drop contact structure 104 is a drum operatively connected with a drive mechanism, for example, an electric motor, which causes moveable surface 106 (the surface of the drum) to rotate. Moveable surface 106 is a solid surface with a thin layer of accumulated liquid that rotates in a clockwise direction (represented by arrow 105). In other example embodiments, moveable surface 106 can rotate in a counter clockwise direction.

As shown in FIG. 4A and FIG. 4B, moveable surface 106 of the drop contact structure 104 is the surface of the rotatable drum covered by a layer of liquid. The liquid layer is formed by drops ejected from the jetting module that accumulate on the surface of the drum. Alternative example embodiments of the present invention include a moveable surface 106 without a liquid layer.

Figure 5B:
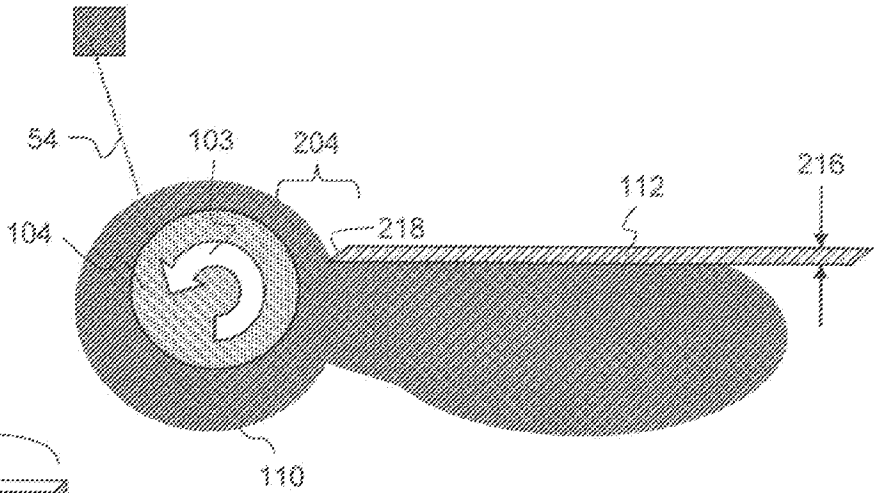
FIGS. 5A and 5B are schematic views of an example embodiments of a portion of a catcher of the continuous printhead shown in FIGS. 4A and 4B.
Figure 5A:
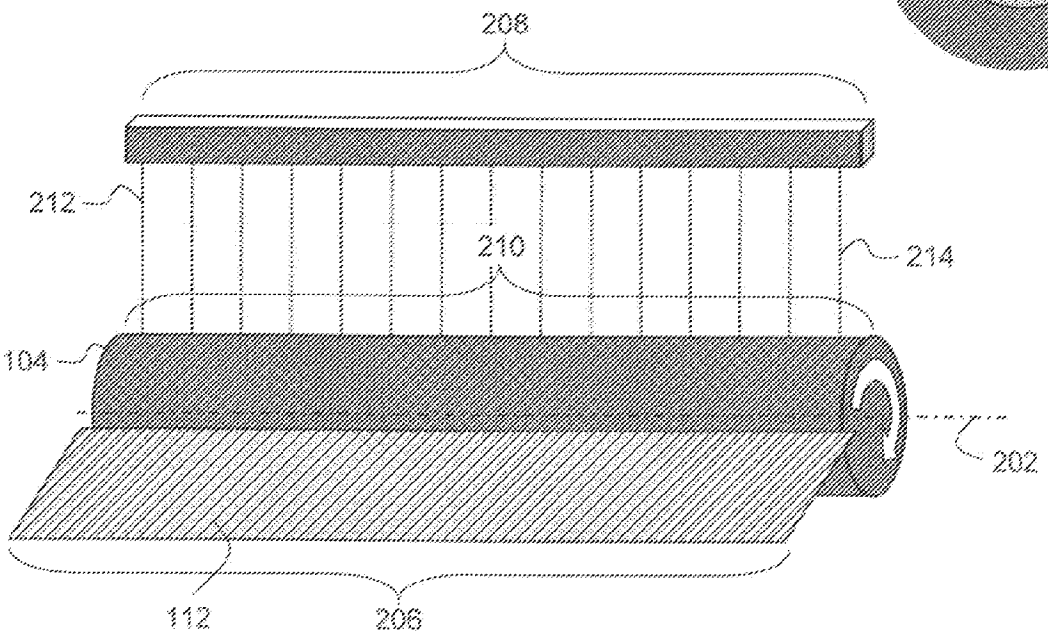

Referring to FIG. 5A, an additional example embodiment of the Coanda catcher of the present invention is shown. Liquid removal mechanism is a skive 112 that removes liquid 110 from the moveable surface 106 of the drop contact structure 104 although other types of liquid removal mechanisms can be used, as discussed in more detail below. The end 102 of skive 112 can be positioned to contact the moveable surface 106 in order to remove liquid layer 110 as the moveable surface 106 rotates past end 102 of skive 112. When end 102 of skive 112 contacts moveable surface 106, end 102 is typically made from a compliant material, for example, a compliant polymer material, in order to reduce wear on the moveable surface 106. Skive 112 is positioned parallel to a length axis 202 of the movable surface 106 of the drop contact structure 104.

Referring to FIG. 5B, an additional example embodiment of the Coanda catcher of the present invention is shown. Liquid removal mechanism is a skive 112 that removes liquid 110 from the moveable surface 106 of the drop contact structure 104 although other types of liquid removal mechanisms can be used, as discussed in more detail below. The end 102 of skive 112 is positioned spaced apart from moveable surface 106 forming a gap 204 between end 102 and surface 106. As such, some of liquid layer 110 is removed as the moveable surface 106 rotates past end 102 of skive 112 while some of the liquid layer 110 is left on moveable surface 106. Skive 112 is positioned parallel to a length axis 202 of the movable surface 106 of the drop contact structure 104.

In some applications, the presence of gap 204 between skive 112 and the moveable surface 106 of the drop contact structure 104 is preferred. Gap 204 helps to reduce wearing of the drop contact structure 104 and skive 112 lengthening the lifetimes of both components. Gap 204 also leaves a thin layer of liquid 110 coated on the moveable surface 106 of skive 112. The thin layer of liquid 110 on the moveable surface helps to reduce liquid misting that may be generated when the drops 54 interact with drop contact structure 104. The dimensions of gap 204 are determined by the thickness of the liquid layer required on moveable surface 106. Typically, the gap 204 is between 0 to 1000 microns depending on the specific application contemplated. Specific dimensions of gap 204 are typically determined through experimentation or using numerical calculations.

It is preferred that the liquid layer 110 remaining on the moveable surface 106 after passing by skive 112 be uniform at least one of thickness and coverage. To help ensure uniformity of the liquid layer 110, skive 112 and the moveable surface 106 of the drop contact structure 104 are aligned relative to each other.

Referring back to FIGS. 5A and 5B, drop contact structure 104, for example, the rotating drum, should be structurally rigid. Material, such as stainless steel, Tungsten, or Aluminum, each of which has a high modulus of elasticity (or Young's modulus) is preferred. Other materials, such as plastics, ceramic, or glass can also be used depending on the application. Moveable surface 106 of the drop contact structure 104 can be polished or coated with hydrophilic or hydrophobic layers, depending on the properties of the liquid collected by catcher 42. Surface 106 can also include some texture or roughness in order to reduce the likelihood of the liquid drops slipping on the moving surface 106 of the drum. The liquid film created by the liquid drops also has more of a tendency to adhere to textured surface 106 (when compared to a non-textured surface) which reduces the likelihood of the liquid drops splattering or liquid mist forming when the liquid drops contact the moving surface 106.

Skive 112 should also be rigid in order to minimize any structural vibration that it might be introduced into the system. As such, skive 112 is usually made from a thin sheet of plastic, stainless steel, or aluminum. The surface of the skive 112 may be coated with hydrophilic or hydrophobic layers, depending the properties of the liquid collected by catcher 42. The edge 218 of skive 112 should be straight to ensure alignment with moveable surface 106 of drop contact structure 104. Usually, it is preferable that the edge 218 of skive 112 be shaped like a "knife-edge" in order to facilitate removal of liquid 110.

The length 210 of drop contact structure 104 should be the same as or longer than the printhead width 208. The width 206 of the device that removes liquid from the moveable surface 106 should also be the same as or longer than the printhead width 208. Printhead width 208 is typically includes at least the distance between the first jet 212 and the last jet 214 (as viewed from left to right in the figure). The thickness 216 of skive 112 can be determined so as to accommodate system integration. Typically, thickness 216 of the skive 112 ranges from 10 microns to 4 mm. Reinforcing structures of mounting fixtures can be used as is necessary to secure skive 112 when skive 112 is thin or made from a structurally weak material.

Figure 6A:
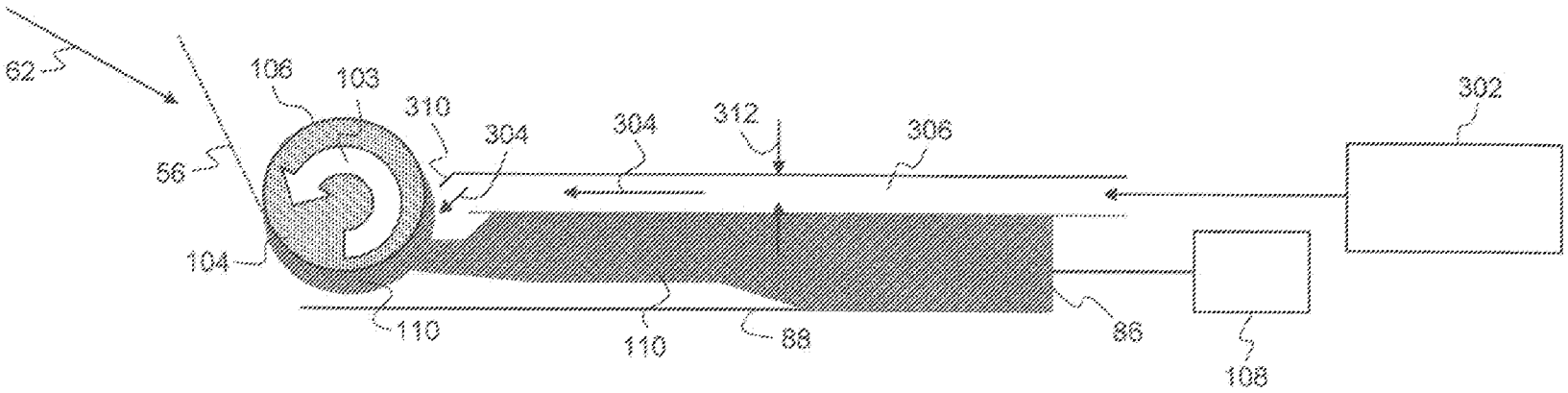
FIGS. 6A and 6B are schematic views of additional example embodiments of a portion of a catcher of the continuous printhead shown in FIGS. 4A and 4B.

Referring to FIG. 6A, the device that removes liquid from the moveable surface of the drop contact structure 104 is a gas flow knife 304. A source of compressed gas 302 (often referred to as a positive pressure gas flow) is connected to gas flow duct 306 and generate a gas flow knife (represented by arrows 304). The gas flow knife 304 is directed on the moveable surface 106 of the drop contact structure 104 to remove liquid 110 accumulated on moveable surface 106. One commonly available source of compressed gas 302 is air, although other gases such as nitrogen, carbon dioxide, helium, or vapor can also be used. Typically, a blower or a pump is used to compress the gas. Alternatively, self contained tank of compressed gas can be used.

The gas flow knife 304 can be pre-heated so that the gas flow knife 304 can heat up the drop contact structure 104 or the liquid 110, if necessary. Maintaining the moveable surface 106 of the drop contact structure 104 or the liquid 110 at an elevated temperature helps to control the viscosity of the liquid 110. This is especially beneficial in applications in which the viscosity of the liquid 110 is very sensitive to temperature. In these applications it is often desirable to maintain the viscosity of the liquid at a reduced level. Active heating helps to keep liquid viscosity low or otherwise controlled, so that removal of the liquid 110 from the moveable surface 106 using gas flow knife 304 or skive 112 is more manageable than it would be otherwise. In these example embodiments, a heating mechanism can be operatively associated with the source of the compressed gas 302. When the gas flow knife 304 is pre-heated, it is preferable that the gas flow duct 306 be made from thermal insulation materials. In most applications, the thermal insulation materials are materials whose thermal conductivity is equal or less than 20 W/(m·K). Materials such as glass, plastics, ceramic, or polypropene can be used to make gas duct 306. When gas flow knife 304 is not pre-heated, the gas duct 306 can be made from materials such as stainless steel, aluminum, and copper.

In FIG. 6A, gas flow duct 306 is straight while the outlet 310 of the gas flow duct 306 includes an angle to enable allow gas flow knife 304 efficiently remove liquid 110 from moveable surface 106. Other adjustments to the outlet 310 can be made. For example, outlet 310 of the gas flow duct 306 can be straight or narrowed relative to other portions of the gas flow duct 306. The thickness 312 of the gas flow duct 306 and the velocity of the gas flow knife 304 are typically controlled by the viscosity of the liquid 110 and usually determined using experimentation or numerical calculations.

A source of vacuum 108 is connected to the liquid removal conduit 86 of the housing. The source of vacuum 108 creates a negative pressure in the liquid removal conduit 86 of the housing to draw liquid 110 in the conduit 86 away from the movable surface 106 of the drop contact structure 104. The level of the level of vacuum 108 need to be such that it can efficiently draw the liquid 110 away while in the mean time is not strong enough to significantly disturb the gas flow.

Figure 6B:
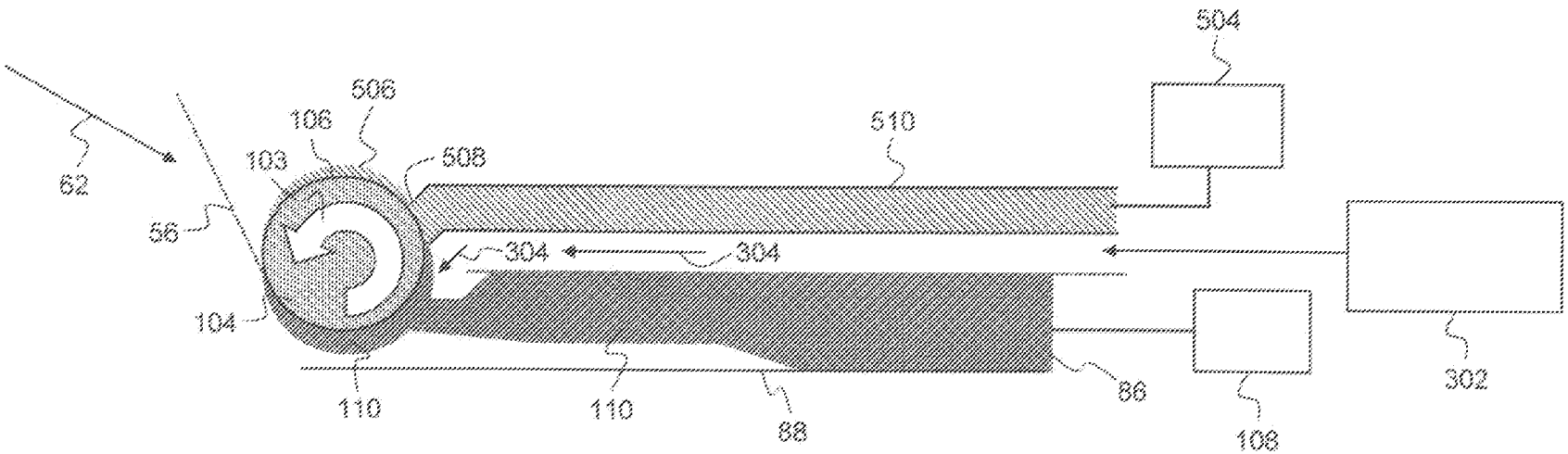

Referring to FIG. 6B, moveable surface 106 can include a liquid surface that is not completely formed from accumulated drops 54 or 56. In this example embodiment, a liquid source 504 is configured to provide a liquid 506, for example, ink or water, to moveable surface 106 of drop contact structure 104 through a liquid flow duct 510. After gas flow knife 304 removes at least some of liquid layer 110 from moveable surface 106 of drop contact structure 104, liquid 506 flowing from liquid duct 510 provides a uniform layer of liquid 506 on moveable surface 106 of drop contact structure 104.

It is preferable that the viscosity of liquid 506 be less than the viscosity of liquid drops 54 or 56 that contact the drop contact surface. This helps to maintain a thin layer of the liquid on the moveable surface 106 and facilitates removal of some or all of the liquid film using the gas flow knife 304 or skive 112. For example, liquid 506 can be water or liquid 506 can be the same as drops 54 or 56 that contact the drop contact surface only provided at a higher temperature than the drops 54 or 56 that contact the drop contact surface. In this configuration, a heating component can be operatively associated with the liquid source 504 to heat the liquid 506 in order to reduce its viscosity.

To ensure the uniformity of the liquid layer 506, liquid flow duct 510 and moveable surface 106 of drop contact structure 104 are aligned relative to each other. Liquid flow duct 510 and moveable surface 106 are spaced apart from each other forming a gap 508. The dimensions of the gap 508 between liquid duct 510 and moveable surface 106 of the drop contact structure 104 are usually determined by desired thickness of liquid layer 506. Typically, the gap 508 is between 0 to 1000 microns.

Liquid flow duct 510 can be a hollow channel or a channel filled with a porous material. It is preferable that the liquid flow duct 510 be made from thermally insulating materials when the temperature of the liquid 506 provided by the liquid duct 510 is greater than the temperature of the drops 54 or 56 that contact the surface 106 of drop contact structure 104.

Typically, materials such as glass, plastics, ceramic, or polypropene can be used to provide thermal insulating properties. When higher liquid temperatures are not required for the liquid in the liquid flow duct 510, the duct 510 can be made from materials such as stainless steel, aluminum, or copper.

Figure 7:
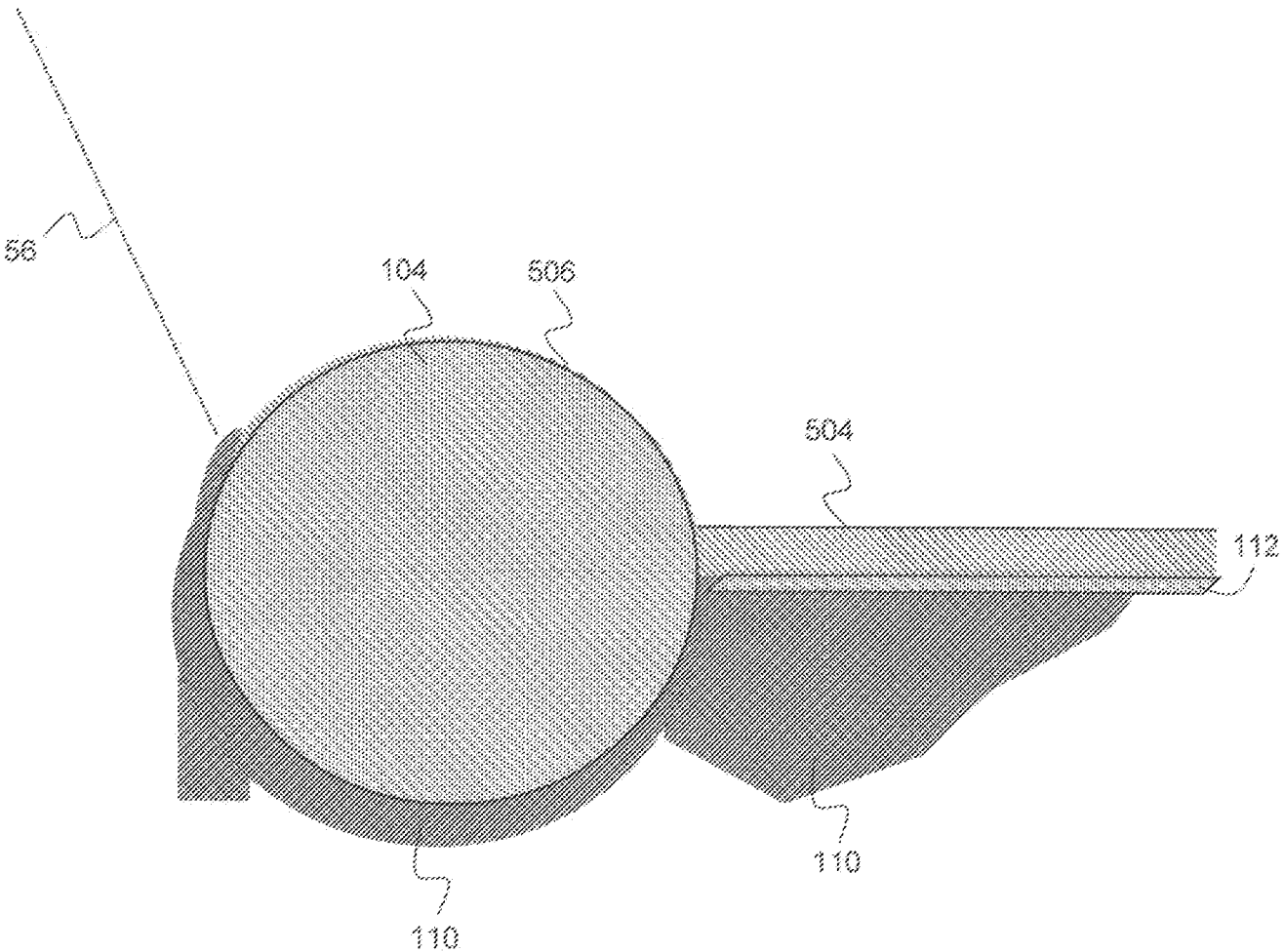
FIG. 7 is a schematic view of another example embodiment of a portion of a catcher of the continuous printhead shown in FIGS. 4A and 4B.

Referring to FIG. 7, liquid surface 506 is used in conjunction with skive 112. After the skive 112 removes most of liquid layer 110 from moveable surface 106 of drop contact structure 104, liquid source 504 provide a uniform layer of liquid 506 to moveable surface 106 of drop contact structure 104. As described above, it is preferable that the viscosity of liquid 506 be lower than the viscosity of the liquid drops 54 or 56 that contact the drop contact surface 106 of drop contact structure 104. For example, liquid 506 can be water or the same liquid as that of drops 54 or 56 only provided at a higher temperature than the drops that contact the drop contact surface.

Figure 8:
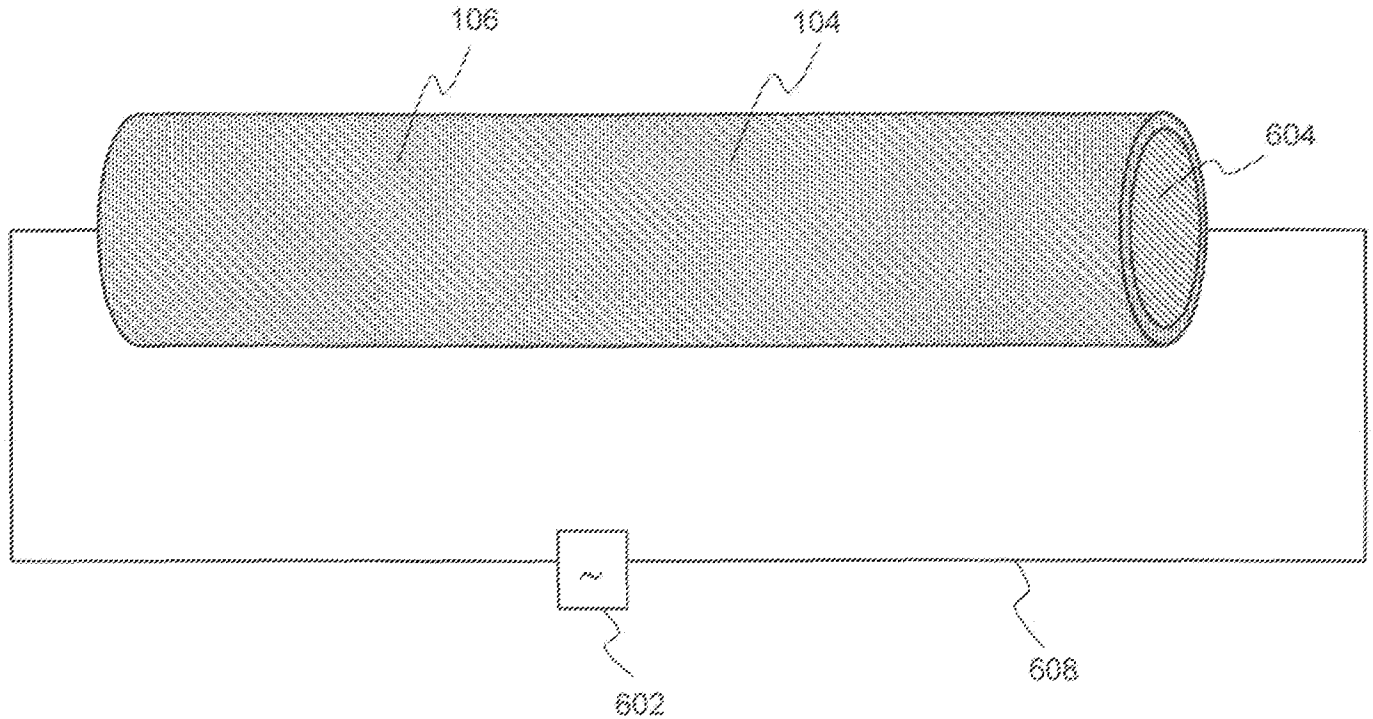
FIG. 8 is a schematic view of another example embodiment of a portion of a catcher of the continuous printhead shown in FIGS. 4A and 4B.

Referring to FIG. 8, a heating mechanism 604 is associated with the drop contact structure 104. Heating mechanism 604 is configured to heat moveable surface 106 of drop contact structure 104. The heating mechanism 604 includes a structure, for example, a series of resistive electro-thermal heaters associated with drop contact structure 104 that heat moveable surface 106. The resistive electro-thermal heaters can include an array(s) of conventional high electrical resistance wires embedded in drop contact structure 104. A power source 602 is in electrical communication or otherwise operatively associated with the heating mechanism 604 through a conductive path 608. A thermal sensing device, for example, temperature sensing resistors, can also be integrated into the drop contact structure 104 to measure the temperature of moveable surface 106 in order to maintain the temperature of moveable surface 106 at a desired level. Alternatively, non-intrusive thermal sensing devices such as inferred thermal cameras can be used to monitor the temperature of moveable surface 106 in order to maintain the temperature of moveable surface 106 at a desired level. In these example embodiments, materials with high coefficients of thermal expansion (CTE) should be avoided when forming drop contact structure 104 in order to minimize shape distortion of drop contact structure 104 when it is heated.

Maintaining the moveable surface 106 of the drop contact structure 104 at an elevated temperature helps to control the viscosity of the liquid 110. This is especially beneficial in applications in which the viscosity of the liquid 110 is very sensitive to temperature. In these applications it is often desirable to maintain the viscosity of the liquid at a reduced level. Active heating helps to keep liquid viscosity low or otherwise controlled, so that removal of the liquid 110 from the moveable surface 106 using gas flow knife 304 or skive 112 is more manageable than it would be otherwise.

Figure 9B:
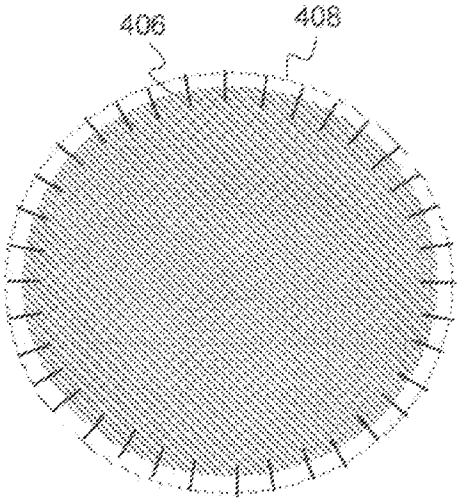
FIGS. 9A and 9B are schematic views of another example embodiment of a portion of a catcher of the continuous printhead shown in FIGS. 4A and 4B.
Figure 9A:
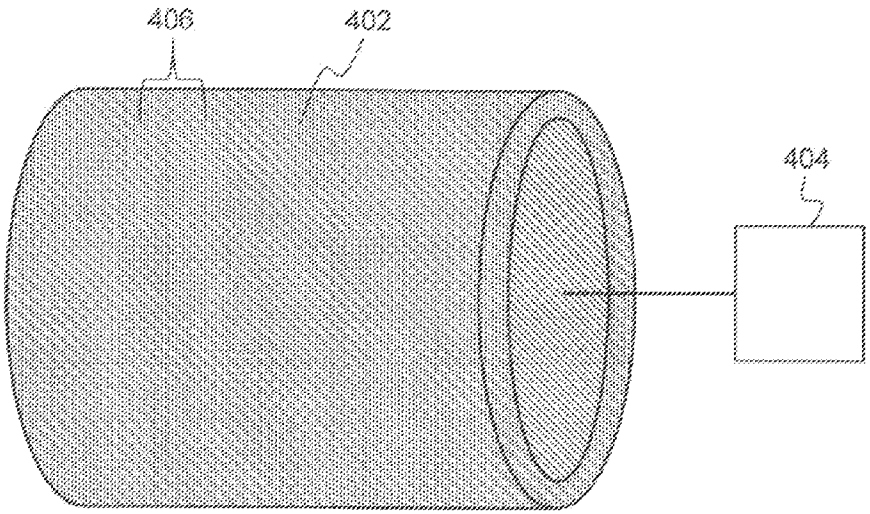

Referring to FIGS. 9A and 9B, drop contact structure includes a drum 402 with a plurality of holes 406. A liquid source 404 is configured to provide a liquid through the plurality of holes 406 to create liquid surface 408 of the drop contact structure. The size of holes 406 are microscopic, ranging from sub-micron to 500 microns in diameter, which helps to reduce the likelihood of liquid spinning off of drum 402. The specific sizes of holes 406 are typically determined using at least one of the following factors: the viscosity and density of the liquid provided by liquid source 404, the rotating speed of drum 402, the external diameter of drum 402, and the thickness of the liquid surface 408.

The drum can be made from silicon tubes, titanium tubes, nickel tubes, aluminum tubes, ceramic tubes or stainless tubes. Titanium tubes, for example, are preferable for this embodiment because of its rigidity and extreme smoothness. Microscopic holes 406 can be made using conventional technologies, for example, chemical etching, laser drilling, or electroforming. An example of suitable ceramic tubes includes those commercially available from Accuratus Corporation, Phillipsburg, N.J.

The drum 402 including the plurality of holes 406 can be connected to a motor so that the drum can be rotated. In these embodiments, the size of holes 406 should be coordinated with the drum rotating speed so that liquid will not spin off moveable surface 408 of the drop contact structure. Additionally, the heating mechanism 604 described with reference to FIG. 8 can be associated with the drum 402.

Figure 10:
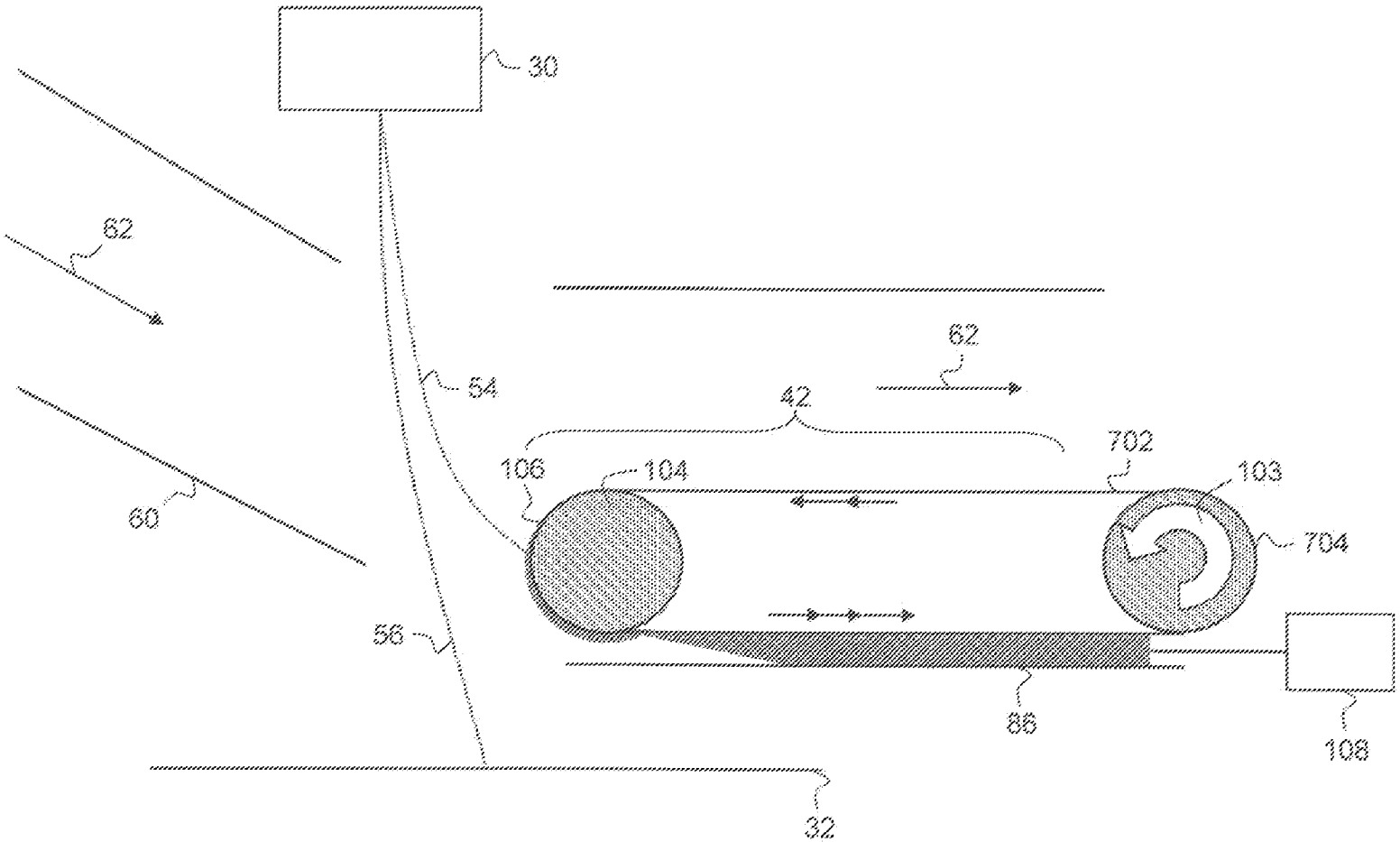
FIG. 10 is a schematic view of another example embodiment of a continuous printhead made in accordance with the present invention.

Referring to FIG. 10, moveable surface 106 of drop contact structure 104 includes a flexible member 702 moveably positioned relative to liquid removal conduit 86 of catcher 42. Flexible member 702 is a belt although other types of flexible members are permitted. As shown in FIG. 10, the large drops 56 print on the recording medium 32 while small drops 54 are intercepted by the flexible member 702 of the catcher 42. The flexible member 702 collects small drops 54 and further delivers the collected liquid drops to the liquid removal conduit 86 of catcher 42.

Flexible member 702 can be a urethane belt(s) like those that are commercially available from Engineered Tilton Components, Tilton, N.H. The surfaces of the flexible member 702 can be coated with a layer of hydrophobic or hydrophilic materials if necessary. It is preferable that the width of flexible member 702 be at least as wide as the printhead width, and, it is more preferable that the width of flexible member 702 be wider than the printhead width in order to help reduce or even eliminate end jet effects. Movement of flexible member 702 can be accomplished using any known mechanism. For example, flexible member 702 moves through a path defined by at least one rotating member, for example, a pulley or a gear 704. One or more of the rotating members can be motorized to operate as the driving mechanism for moving flexible member 702.

Flexible member 702 travels over the drop contact structure 104. Drop contact structure 104 can be stationary or rotating. It is preferable to have the widths of the pulley or the gear 704 be substantially as wide as flexible member 702 in order to help flexible member 702 travel as smoothly as is possible. Although FIG. 10 shows the printhead operating in a large drop print mode, it should be appreciated that the printhead can be reconfigured to operate in a small drop print mode using flexible member 702 of drop contact structure 104 to collect non-printed drops.

Advantageously, the catcher of the present invention maximizes liquid removal rates with a reduced drop contact surface area while maintaining structural robustness. Additionally, the catcher of the present invention reduces liquid build up on the drop contact surface of the catcher.

The invention has been described in detail with particular reference to certain preferred embodiments thereof, but it will be understood that variations and modifications can be effected within the scope of the invention.

Parts List

20 continuous printer system
22 image source
24 image processing unit
26 mechanism control circuits
28 device
30 printhead
32 recording medium

34 recording medium transport system
36 recording medium transport control system
38 micro-controller
40 reservoir
42 catcher
44 recycling unit
46 pressure regulator
47 channel
48 jetting module
49 nozzle plate
50 plurality of nozzles
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
86 liquid return duct
88 plate
90 front face
92 positive pressure source
94 negative pressure source
96 wall
102 end
103 arrow
104 drop contact structure
105 arrow
106 moveable surface
108 source of vacuum
110 liquid
112 skive
202 length axis
204 gap
206 width
208 printhead width
210 length
212 first jet
214 last jet
216 thickness
218 edge
302 source of compressed gas
304 gas flow knife
306 gas flow duct
312 thickness
402 drum
404 liquid source
406 plurality of holes
408 liquid surface
504 liquid source
506 liquid
508 gap
510 liquid flow duct
602 power source
604 heating mechanism
608 conductive path
702 flexible member
704 gear

The invention claimed is:

1. A catcher for use with a continuous printer that produces a stream of liquid drops in which some of the liquid drops are selected to be print drops while other liquid drops are selected to be non-print drops the catcher comprising:

a housing defining a liquid removal conduit; and a drop contact structure including a moveable surface , the moveable surface being positioned to intercept only a trajectory of the non-print liquid drops, collect the liquid of the non-print liquid drops, and deliver the collected liquid to the liquid removal conduit of the housing.

2. The catcher of claim 1, wherein the moveable surface is at least one of a liquid surface and a solid surface.

3. The catcher of claim 1, wherein the drop contact structure includes a drum rotatably positioned relative to the liquid removal conduit of the housing.

4. The catcher of claim 1, further comprising:

a device that removes liquid from the moveable surface of the drop contact structure.

5. The catcher of claim 4, wherein the device is a gas flow knife.

6. The catcher of claim 5, wherein the gas flow knife is pre-heated.

7. The catcher of claim 4, the moveable surface having a length dimension, wherein the device is a skive positioned parallel to the length axis of the moveable surface of the drop contact structure.

8. The catcher of claim 4, further comprising:

a source of vacuum connected to the liquid removal conduit of the housing to create a negative pressure in the liquid removal conduit of the housing that draws liquid in the conduit away from the rotating surface of the drop contact structure.

9. The catcher of claim 1, further comprising:

a source of vacuum connected to the liquid removal conduit of the housing to create a negative pressure in the liquid removal conduit of the housing that draws liquid in the conduit away from the rotating surface of the drop contact structure.

10. The catcher of claim 1, wherein the drop contact structure comprises:

a drum rotatably positioned relative to the liquid removal conduit of the housing, the drum including a plurality of holes; and a liquid source that is in liquid communication with the plurality of holes, the liquid source being configured to provide a liquid through the plurality of holes to the moveable surface of the drop contact structure.

11. The catcher of claim 1, wherein the drop contact structure comprises:

a drum positioned relative to the liquid removal conduit of the housing, the drum including a plurality of holes; and a liquid source that is in liquid communication with the plurality of holes, the liquid source being configured to provide a liquid through the plurality of holes to create the moveable surface of the drop contact structure.

12. The catcher of claim 1, wherein the drop contact structure comprises:

a drum rotatably positioned relative to the liquid removal conduit of the housing; and a liquid source configured to provide a liquid to the moveable surface of the drop contact structure.

13. The catcher of claim 1, wherein the drop contact structure comprises:

a flexible member moveably positioned relative to the liquid removal conduit of the housing.

14. The catcher of claim 1, further comprising:

a liquid source configured to provide a liquid to the moveable surface of the drop contact structure, the liquid having a viscosity that is lower than a viscosity of the liquid drops that contact the drop contact surface.

15. The catcher of claim 14, wherein the liquid provided by the liquid source is one of water and the same as the drops that contact the drop contact surface but provided at a higher temperature than the drops that contact the drop contact surface.

16. The catcher of claim 1, further comprising:

a heating mechanism associated with the drop contact structure, the heating mechanism being configured to heat the moveable surface.

17. A method of collecting non-print liquid drops from a stream of liquid drops that includes print liquid drops and non-print liquid drops, the method comprising:

providing a catcher including:

a housing defining a liquid removal conduit; and a drop contact structure including a moveable surface, the moveable surface being positioned to intercept only a trajectory of the non-print liquid drops, to collect the liquid of the non-print drops, and to deliver the collected liquid to the liquid removal conduit of the housing;

causing the moveable surface of the drop contact structure of the catcher to move; and causing liquid drops to contact the moving surface of the drop contact structure of the catcher.

18. A catcher comprising:

a housing defining a liquid conduit;

a drop contact structure including a moveable surface that delivers connected liquid drops to the liquid removal conduit of the housing; and a liquid source configured to provide a liquid to the moveable surface of the drop contact structure, the liquid having a viscosity that is lower than a viscosity of the liquid drops that contact the drop contact surface.

19. The catcher of claim 18, wherein the liquid provided by the liquid source is one of water and the same as the drops that contact the drop contact surface but provided at a higher temperature than the drops that contact the drop contact surface.

20. The catcher comprising:

a housing defining a liquid removal conduit;

a drop contact structure including a moveable surface that delivers connected liquid drops to the liquid removal conduit of the housing; and a heating mechanism associated with the drop contact structure, the heating mechanism being configured to heat the moveable surface.

* * * * *